US007527451B2

(12) United States Patent
Slater et al.

(10) Patent No.: US 7,527,451 B2
(45) Date of Patent: May 5, 2009

(54) SUPPORT GRID PLATFORM FOR SUPPORTING VEHICLES OVER ECOLOGICALLY SENSITIVE TERRAIN

(76) Inventors: William B. Slater, 253 High St., Somersworth, NH (US) 03878-1808; William Davis, 5335 E. River Rd., Grand Island, NY (US) 14072

( * ) Notice: Subject to any disclaimer, the term of this patent is extended or adjusted under 35 U.S.C. 154(b) by 0 days.

(21) Appl. No.: 11/944,151

(22) Filed: Nov. 21, 2007

(65) Prior Publication Data

US 2008/0131202 A1 Jun. 5, 2008

Related U.S. Application Data

(63) Continuation-in-part of application No. 11/243,905, filed on Oct. 5, 2005, now Pat. No. 7,300,224.

(51) Int. Cl.
*E02D 3/00* (2006.01)
*E01C 21/00* (2006.01)

(52) U.S. Cl. ..... 404/36; 404/34; 404/35; 405/302.4

(58) Field of Classification Search ..... 404/34–38, 404/41; 405/229, 258.1, 302.4–302.6, 303
See application file for complete search history.

(56) References Cited

U.S. PATENT DOCUMENTS

| | | | | |
|---|---|---|---|---|
| 1,981,489 | A | | 11/1934 | Wilson |
| 2,128,753 | A | | 8/1938 | Lienhard |
| 2,315,448 | A | | 3/1943 | Nagin et al. |
| 2,361,164 | A | | 10/1944 | Arthur |
| 2,912,910 | A | | 11/1959 | Wilson et al. |
| 2,975,977 | A | | 3/1961 | Chodacki et al. |
| 3,836,075 | A | | 9/1974 | Botbol |
| 3,858,803 | A | | 1/1975 | Gantert |
| 3,909,996 | A | * | 10/1975 | Ettlinger et al. ..... 52/177 |
| D241,493 | S | | 9/1976 | Ettlinger, Jr. et al. |
| 4,111,585 | A | * | 9/1978 | Mascaro ..... 404/70 |
| 4,226,064 | A | | 10/1980 | Kraayenhof |
| 4,436,779 | A | | 3/1984 | Menconi et al. |
| 4,584,221 | A | | 4/1986 | Kueng |
| 4,596,731 | A | | 6/1986 | Cudmore et al. |
| 4,621,942 | A | | 11/1986 | Hill |
| 4,650,115 | A | | 3/1987 | Fontaine |
| 4,671,699 | A | | 6/1987 | Roach |
| 4,826,351 | A | | 5/1989 | Haberhauer et al. |
| 4,963,054 | A | | 10/1990 | Hayashi |
| 5,287,649 | A | | 2/1994 | Prestele |
| 5,364,204 | A | | 11/1994 | MacLeod |
| D355,807 | S | | 2/1995 | O'Rourke |
| 5,439,171 | A | | 8/1995 | Fruend |
| 5,538,183 | A | | 7/1996 | McGee |

(Continued)

*Primary Examiner*—Raymond W Addie
(74) *Attorney, Agent, or Firm*—Daniels Patent Law PLLC; Scott A. Daniels

(57) ABSTRACT

A grid-type platform especially suited for use supporting vehicle wheels to provide traction while traveling off-road especially through environmentally sensitive topography, and to prevent unnecessary and excessive wear and damage to such off-road paths or trails. More specifically this invention relates to a grid-type platform having a plurality of grid sections defined by intersection lateral and longitudinal walls and having an intermediate support designed to provide all-terrain vehicles and four-wheel drive vehicles the necessary traction to reduce tire slippage and rutting when traveling through off-road trails or paths particularly through environmentally sensitive areas.

8 Claims, 15 Drawing Sheets

U.S. PATENT DOCUMENTS 5,628,160 A 5/1997 Kueng
5,822,944 A 10/1998 Penland, Sr.
5,833,136 A 11/1998 Japp
D414,281 S * 9/1999 Sassenberg ..... D25/152
6,171,015 B1 1/2001 Barth et al.
6,305,875 B1 * 10/2001 Matsumoto ..... 405/16
6,511,257 B1 1/2003 Seaux et al.
6,531,203 B2 3/2003 Kessler et al.
6,554,545 B1 * 4/2003 Hall ..... 405/302.4
6,652,183 B2 11/2003 Stasiewich et al.
6,695,527 B2 2/2004 Seaux et al.
6,746,176 B2 6/2004 Smith
7,121,759 B2 10/2006 Woodson et al.

* cited by examiner

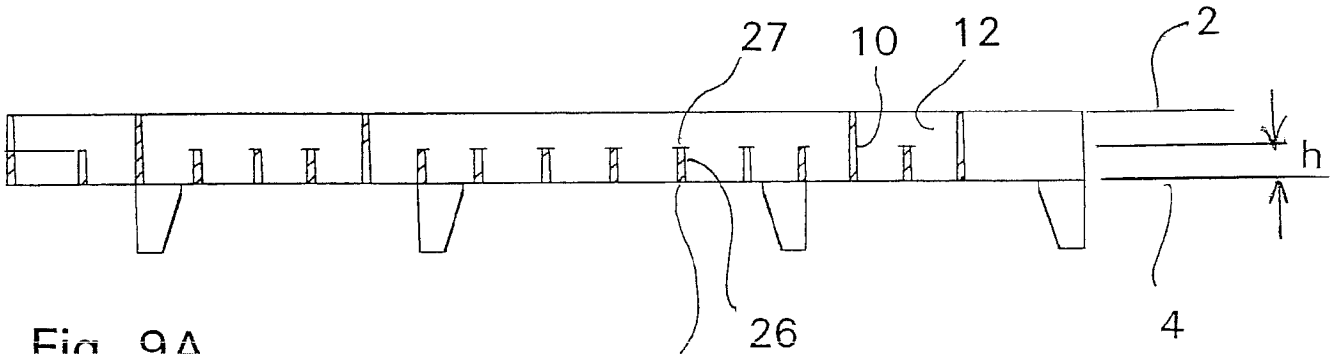
Fig. 9A
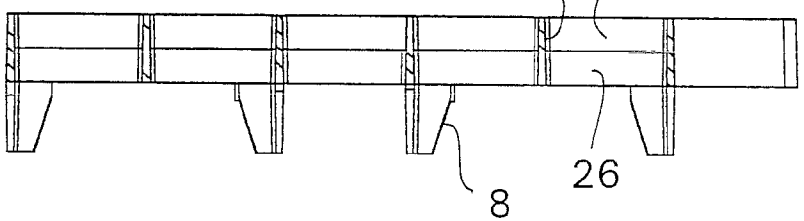
Fig. 9B
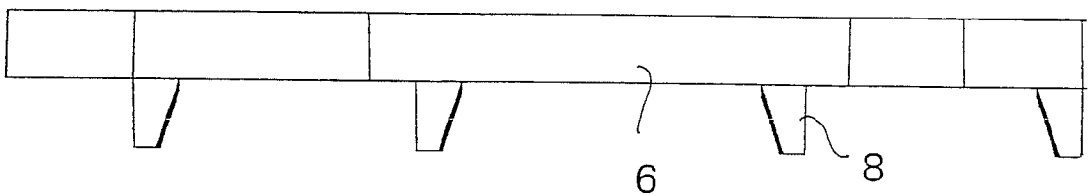
Fib. 9C

SUPPORT GRID PLATFORM FOR SUPPORTING VEHICLES OVER ECOLOGICALLY SENSITIVE TERRAIN

This application is a continuation-in-part of U.S. patent application Ser. No. 11/243,905 filed Oct. 5, 2005.

FIELD OF THE INVENTION

This invention relates to a platform especially suited for use supporting vehicle wheels to provide traction while traveling off-road especially through environmentally sensitive topography and to prevent unnecessary and excessive wear and damage to such off-road paths or trails. More specifically, this invention relates to a grid-type platform designed to provide all-terrain vehicles (ATVs) and four-wheel drive vehicles the necessary traction to reduce tire slippage and rutting when traveling through off-road trails or paths particularly through environmentally sensitive areas. Furthermore, this invention will minimize ecological damage, destruction and wear, for example, to wetlands, by retaining loose or saturated soil, rock, sand, etc., on the off-road trails.

BACKGROUND OF THE INVENTION

Over recent years, all-terrain vehicles (ATVs) and four-wheel drive (4WD) vehicles have become more and more popular for recreational purposes. "Off-roading" or "four-wheeling" are terms used to describe the act of driving an ATV or 4WD vehicle off a normal paved or unpaved streets. Off-roading is usually done in rural areas on trails, open fields or wooded areas. While some people use ATV or 4WD vehicles for transportation to hunting or fishing grounds, most people use them strictly for recreational purposes.

There are many state parks and private land owners which allow ATV and 4WD vehicles, usually on marked trails. One of the biggest problems faced with these off-roading trails is that because of the rather large tires and necessary engine torque inherent in such ATVs substantially deep ruts and grooves begin to form in the trails, especially in low-lying wetlands, after excessive use. Consistent wear on a trail by ATV and 4WD vehicle tires can cause irreparable ecological damage to the trail and to the local (environment especially in ecologically sensitive areas such as wetlands.

The deep treaded tires found on ATV and 4WD, have a damaging effect on nearly all types of surfaces. On a hard surface, such as a paved road, a tire is very efficient. An ATV or 4WD vehicle can move forward with the engine at an idle and very little power. Loose dirt on the hard surface will be compressed, but not kicked-up or displaced. On such a surface, there is minimal wear damage, however, the loose dirt on the hard surface may be displaced and eventually erode the surface until it reaches a near irreparable state.

On softer surfaces, such as a meadow, open field or wetland, the wheel and tire will typically sink into the surface under the weight of the vehicle. In these situations, the tire has to continually climb out of the depression it has created. This continuous climb requires extra power, similar to a car climbing up a hill at a similar angle to the tire climbing out of its depression. The climb out is such hard work for the tire that the lugs slip a small amount before they can compress the soil behind the lug enough to grip the surface. This slippage is constant as the vehicle moves forward. As the tire slips, plants under the tire are torn or pulled from the ground. On these surfaces, it takes as few as one vehicle to cause permanent damage to the ground, wetland and the vegetation.

No matter how slowly and carefully a vehicle is driven on soft ground, the tire always has to climb at a climb out angle and, therefore, a certain amount of slippage and resulting damage always occurs. In fact, high speed may cause less damage on softer ground because there is less time for a deeper depression to occur and thus the climb out angle would be less.

On very soft ground, such as a wetland, an open field after a heavy rain or a meadow at the base of a steep hill, the tire sinks even deeper than in the previous situation. This deeper depression increases the climb out angle and, therefore, more power is needed. As previously described, the tire must overcome the greater angle and, therefore, even greater slippage and thus more destruction results. In these situations, it is common for the tires to be slipping to the point where the dirt and plants which have been compressed will be thrown in the air behind the vehicle.

There may be situations where the ground is so soft and corresponding climb out angle is so steep that the tire spins and the vehicle comes to a halt. As the tire spins into a near vertical wall, dirt and plants are constantly thrown high into the air as the vehicle sinks deeper and deeper in the rut it has created.

Many states in the U.S. have passed laws and regulations banning ATVs and 4WD vehicles from certain parks and areas where the ecological system is too fragile to withstand the damage imposed by use of such vehicles. In some jurisdictions, it is required to use structures for minimizing such trail wear in an attempt to minimize the damage. Traction mats and vehicle support platforms are one solution to this problem.

Traction mats and vehicle support platforms, known in the art, are similar to the present invention, but with certain drawbacks. One of the largest problems with many of the traction mats known in the art is that they are very expensive to manufacture. They are typically made of a heavy material so as to withstand the weight of a vehicle without suffering from permanent deformation, however, many still become permanently warped from continued use. Another problem with previously known vehicle support platforms is their inability to easily connect with another adjacent platform. Many platforms use a pin-pinhole connection method which makes the platforms very difficult to move once it is placed on the ground. Others are not capable of interlocking or interconnecting with other platforms at all.

FIGS. 1 and 2 show two types of traction mats known in the art at the time of the invention. Viewing FIG. 1, the traction mat is made up of certain basic structural features found in door mats used in association with entrance doors of buildings and other places to provide a convenient walking surface for catching mud, dirt or snow from a person's shoes walking thereon. These types of mats are constructed with a unvarying construction and uniform planar upper and lower surfaces.

This mat comprises a series of serpentine traction strips which may be formed from any suitable metal or high-impact plastic. Each strip has alternately opposing undulations defining corresponding alternating openings. The undulations are substantially U-shaped with leg portions that slightly diverge so that the crest portions can fit inter-digitally by projecting into the mouth ends of each opening.

The inter-digited crest portions of the undulations are articulately coupled by way of suitable hinge pin rods desirably formed from gauge wire and extending through aligned holes. To retain the rods against endwise displacement, they are provided with a locking means at their opposite ends. For support at each opposite end of the mat, reinforcing and stabilizing means, such as a closure strip bar, may be provided and which may be formed from the same strip material as the traction strips or may be of a slightly heavier gauge, if preferred. Each of the end bars is secured to the crests of the endmost undulations of the mat as by means of rivets.

Another type of traction mat, as shown in FIG. 2, is primarily made from a plurality of parallel linear strips arranged with the sides of an elongated, generally rectangular protecting grid having a high traction top surface. A second series of parallel linear strips is positioned to the sides of the protecting grid. The grid is fitted on one side with an interlocking means adapted to fit one grid to another. This interlocking means may consist of adapting sides with a plurality of spaced apertures therein.

SUMMARY OF THE INVENTION

There is a need in the art for a vehicle support platform which can overcome the previously discussed problems. The present invention is directed at further solutions to address this need.

In accordance with one aspect of the present invention, a vehicle support platform is designed to disperse the weight of a vehicle and provide improved traction on unstable terrain surfaces.

In accordance with another aspect of the present invention, a vehicle support platform has a non-interlocking jigsaw, profile structure with congruent surface features so the sidewalls of adjacent vehicle support platforms compliment one another.

A further aspect of the present invention is to provide a vehicle support platform with a reinforced grid structure to enhance strength and minimize weight.

Yet another aspect of the present invention is providing strategically positioned cleats to the underside of the vehicle support platform to stabilize motion and to provide a retention support for the platform on the ground underneath.

The invention relates to a vehicle support platform for use in protecting off-road trails and ecologically sensitive terrain comprising a molded platform having a contiguous sidewall defining an outer edge of the platform and connecting a plurality of longitudinal and lateral intersecting support walls defining a planar top and bottom surface for supporting a vehicle thereon; a plurality of cleats depending from the bottom surface of the platform, at least one of a recess or projection formed by the sidewall in the outer edge of the molded platform; the recess or projection being sized to receive or to be received by a corresponding projection or recess in an adjacent vehicle support platform.

The invention also relates to a method of protecting off-road trails and ecologically sensitive terrain from damage from off-road vehicles, the method comprising the steps of placing a molded platform in a desired location having a contiguous sidewall defining an outer edge of the platform and connecting a plurality of longitudinal and lateral intersecting support walls defining a planar top and bottom surface for supporting a vehicle thereon; affixing the molded platform into the terrain by a plurality of cleats depending from the bottom surface of the platform; aligning the molded platform with at least a second adjacent molded platform by forming at least one of a recess or projection in the sidewall in the outer edge of the molded platform; the recess or projection being sized to receive, or to be received by a corresponding projection or recess in the second adjacent molded platform.

BRIEF DESCRIPTION OF THE DRAWINGS

FIGS. 9A, 9B and 9C are cross-sectional front, side and perspective elevational views of the present invention designed for use in sloping, hilly terrain;

DETAILED DESCRIPTION OF THE INVENTION

Figure 1:
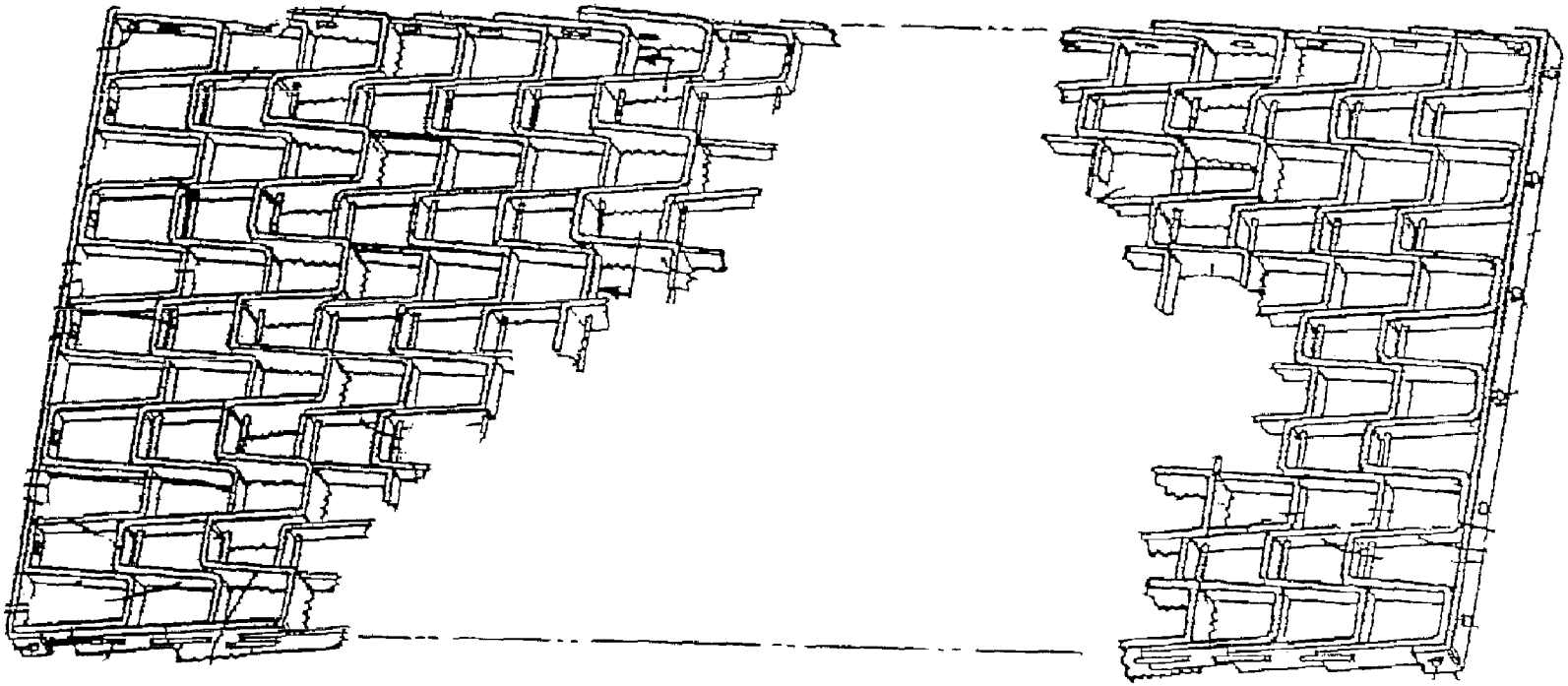
Fig. 1 Prior Art
FIG. 1 is a top broken view of a known traction mat.
Figure 2:
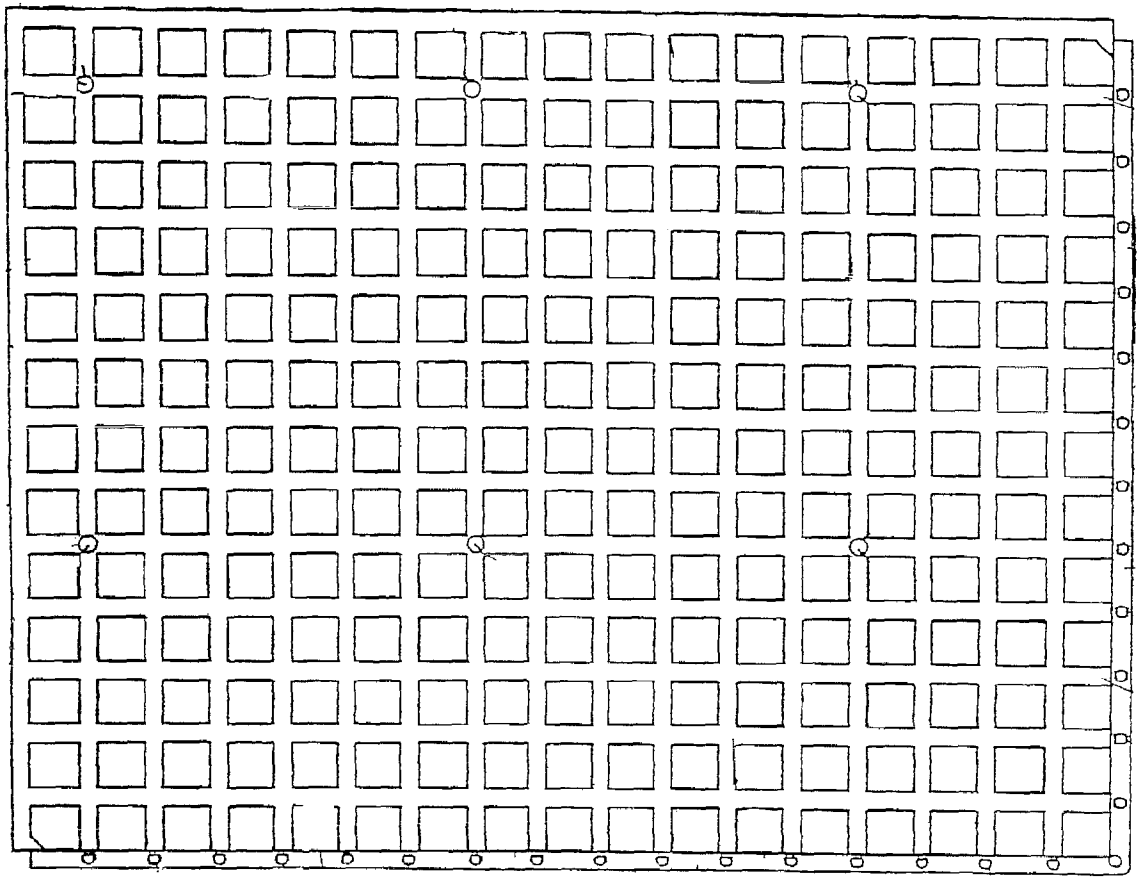
Fig. 2 Prior Art
FIG. 2 is a top elevational view of another known traction mat.
Figure 3:
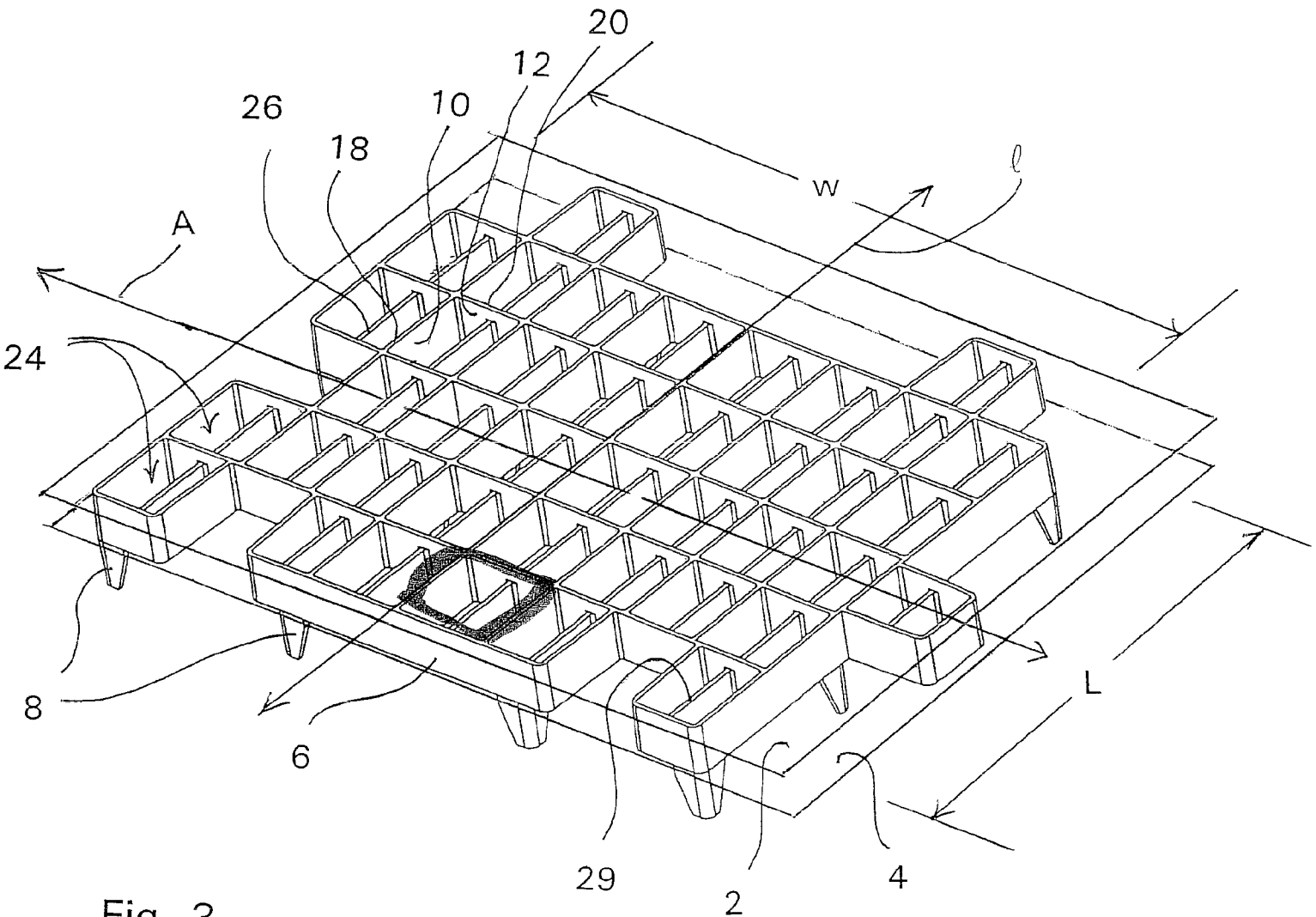
FIG. 3 is a perspective view of the top surface of one embodiment of the present invention designed for use in flat terrain.

The present invention, a vehicle support grid 1 shown in a first embodiment in FIG. 3, is defined, in general, by a framework which is a substantially rigid, single-piece, molded grid structure. The vehicle support grid 1 is defined by a top surface 2 and a bottom surface 4 and delineated by an outer perimeter sidewall 6. A plurality of depending cleats 8 extend from the bottom surface 4 of the grid structure in order to provide an adequate means of securing the grid structure into a desired ground surface. Preferably, the cleats 8 are integrally positioned depending from the outer perimeter sidewall 6 of the vehicle support grid 1, however, it is possible to place the cleats 8 at any location depending from the bottom surface 4 of the platform to accommodate various terrain surfaces.

Each vehicle support grid 1 has a lateral width w and a longitudinal length L, the width w being in the range of about 30 to 60 inches, preferably about 42 inches, and the length being in the range of about 25 to 40 inches, preferably about 30 inches. The sidewall height is between about 2-5 inches and preferably about 3 inches, and the length of the depending cleats 8 between about 2 to 5 inches and preferably about 3 inches. It is important to note the right angular formation of the cleats 8 which facilitates maintaining the support grid in position once positioned on the ground. The right angular nature of the cleats 8 presents perpendicularly adjacent walls 9 and 11 to provide both lateral and longitudinal support horizontally against the ground into which the cleats 8 are placed. Such lateral and longitudinal support keeps the support grid 1 from moving horizontally or twisting once positioned in the ground.

It is to be appreciated that the lateral width w, length L, sidewall height, and cleat length may be variable to some extent, and should not be unduly limited by the above noted ranges, however, it is important that within such ranges as defined above, the vehicle support grids 1 are easily stacked, carried and placed at an appropriate trail location by hand or from an ATV vehicle itself.

The vehicle support grid 1 has a grid pattern encompassed by the outer perimeter sidewall 6 composed of intersecting longitudinal reinforcement bars 10 and lateral reinforcement bars 12. For purposes of the following description, a longitudinal axis l is defined through the center of the vehicle support grid 1 aligned parallel with the longitudinal reinforcement bars 10 and also aligned in the general direction in which an ATV vehicle will travel over the support grid 1. A lateral axis A is correspondingly defined through the middle of the support grid 1, but parallel aligned with the lateral reinforcement bars 12 substantially perpendicular to vehicle travel.

Figure 4:
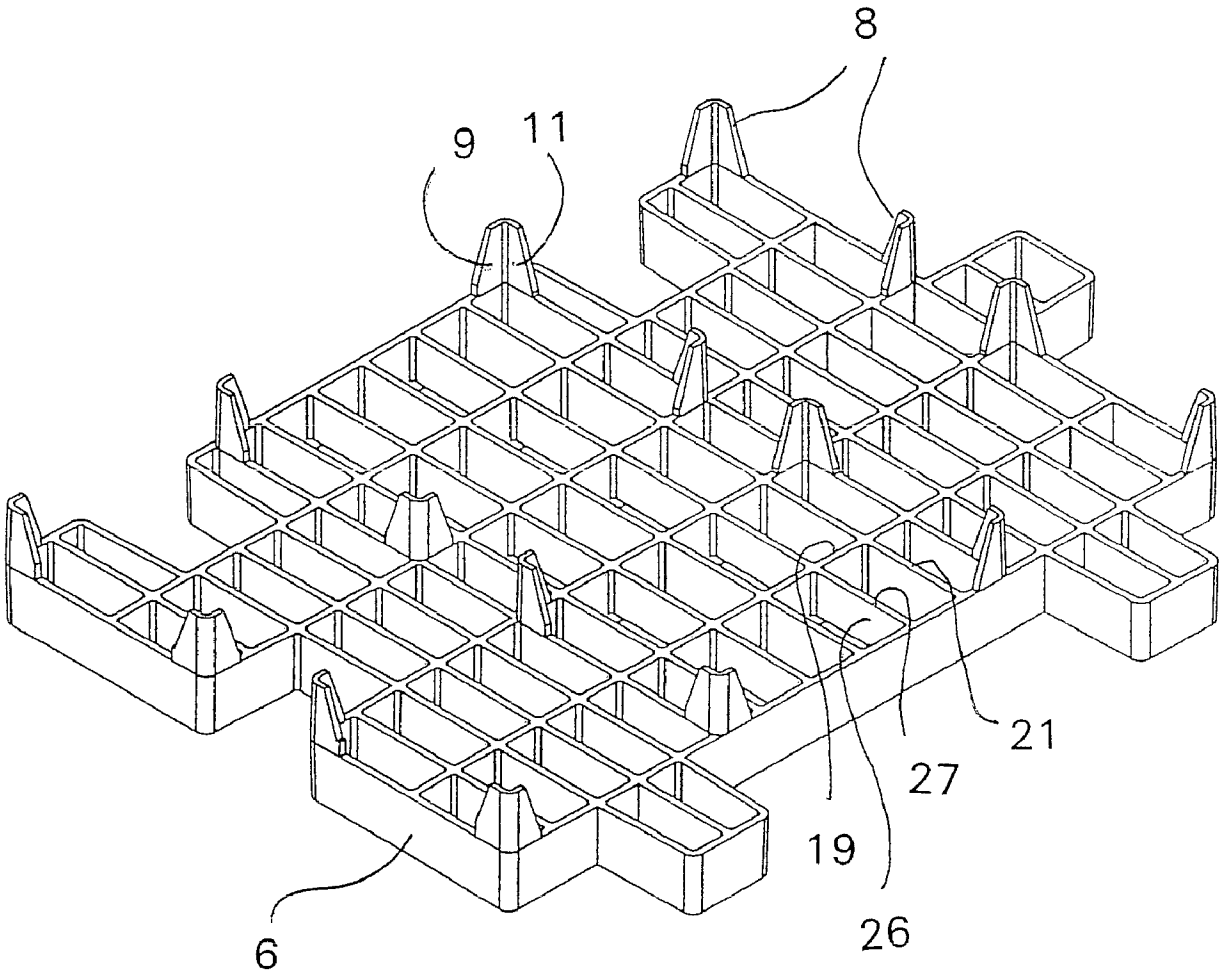
FIG. 4 is a perspective view of a bottom surface of the first embodiment of the present invention designed for use in flat terrain.

The longitudinal and lateral reinforcement bars 10, 12 intersect perpendicular with one another and are each provided with respective top edges 18, 20 which are co-planer with one another and further define the top surface 2, as well as bottom edges 19, 21 also co-planar with one another and together define the bottom surface 4 of the support grid 1 as seen in FIG. 4.

Figure 5A:
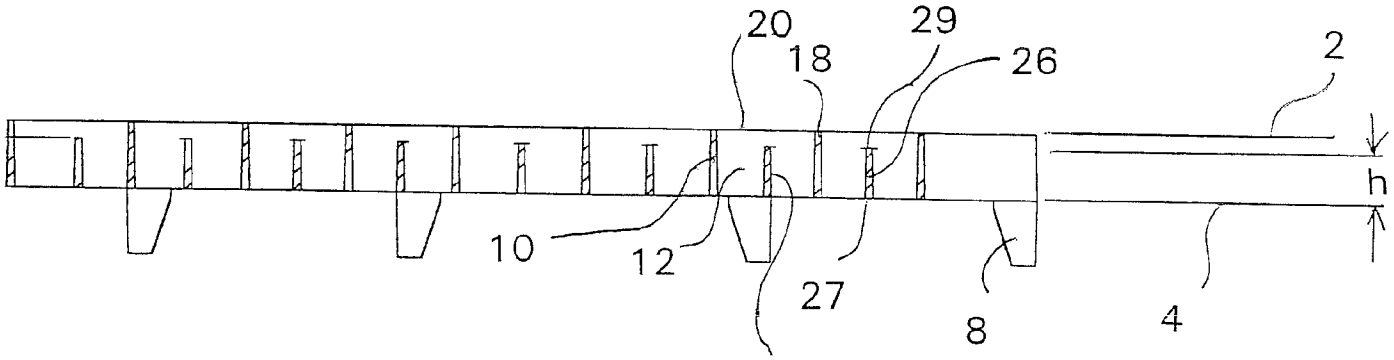
FIGS. 5A, 5B and 5C are cross-sectional front, side and perspective elevational views of the present invention designed for use in flat terrain.
Figure 5B:
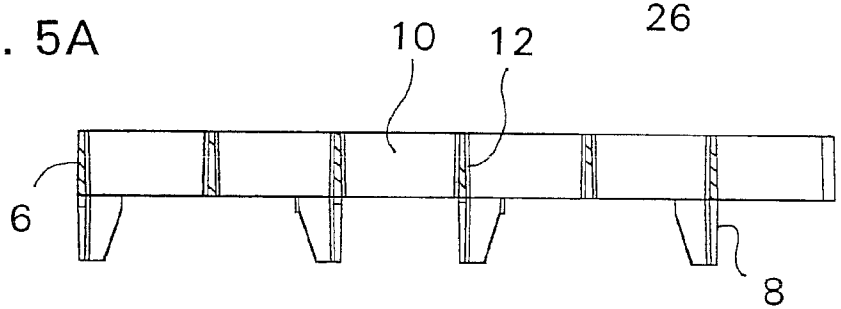
Figure 5C:
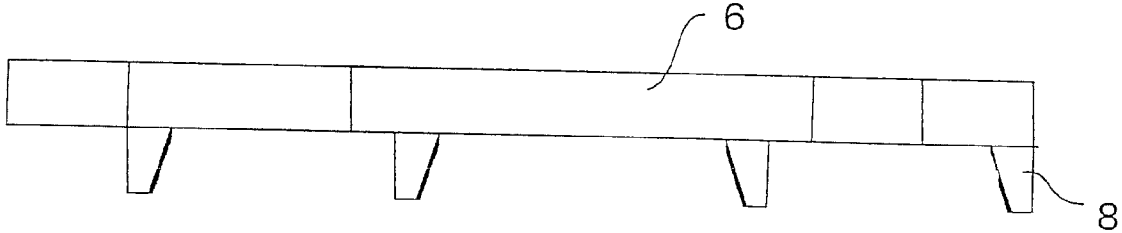
Figure 6:
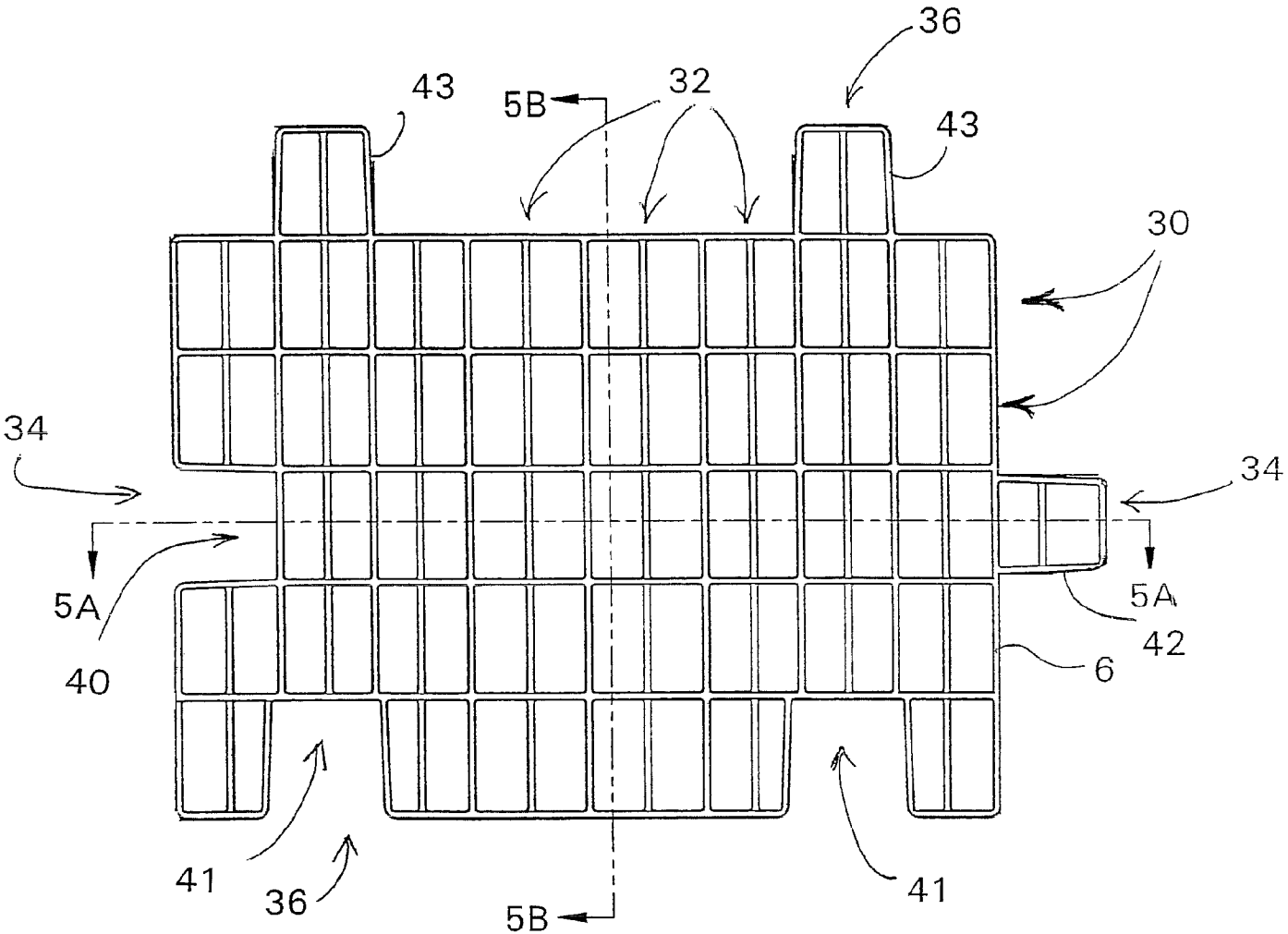
FIG. 6 is a top planar view of the top surface of the grid support of the first embodiment.

The embodiment shown in FIGS. 3-6 is generally for being positioned on relatively flat ground as opposed to a second embodiment to be discussed below for placement on a slope. In this first embodiment, the perpendicularly aligned longitudinal and lateral reinforcement bars 10, 12 define a plurality of grid sections 24. As seen in FIG. 6, each grid section 24 in the present embodiment is shown substantially as, square or rectangular in nature, although other shapes may be possible as well, where each side of the grid section is formed by portions of the intersecting longitudinal and lateral reinforcement bars 10, 12. Each grid section 24 is divided by an intermediate longitudinal reinforcement bar 26, or web, which is aligned parallel, but spaced from the longitudinal reinforcement bars 10 forming the sides of each grid section 24. Correspondingly, the intermediate longitudinal reinforcement bar 26 is integrally connected at a right angle with opposing sides of the grid sections 24 formed by the lateral reinforcement bars 12.

The support grid 1 is usually placed on the ground in a position where the longitudinal axis l of the support grid 1 is aligned parallel with the direction of travel of the vehicle to be supported. In this arrangement, the wheels of the vehicle generally grip the lateral reinforcement bars 12 as the vehicle wheels travel across the support grid 1 in a manner perpendicular to the lateral axis A. The longitudinal reinforcement bars 10 provide little traction or friction to assist in moving the vehicle forward, except for providing structural support to the lateral reinforcement bars 12 and, of course, some vertical support to the vehicle wheels. However, the longitudinal reinforcement bars 10 do impede lateral slippage or sliding of the wheels by intersecting between extending portions of the tire tread, often referred to as "knobbies". These knobby extending protrusions from the wheel are blocked or impeded from lateral movement along the lateral axis A because the knobbies are permitted by the above discussed structure of the grid sections 24 to extend below the level of the top surface 2 as defined by the top edges 18, 20 of the longitudinal and lateral reinforcement bars 10, 12. This is further facilitated by the shorter intermediate longitudinal reinforcement bar 26 allowing more of the vehicle wheels and the knobby tread to fall within the grid section 24 to grip the lateral and intermediate reinforcement bars 12 and 26.

Observing the side, cross-sectional view of FIG. 5A, the intermediate longitudinal reinforcement bar 26 in each grid section 24 has a height h less than that of the adjacent lateral reinforcement bars 12. The intermediate longitudinal reinforcement bar 26 extends from a bottom edge 27 generally aligned co-planar with the bottom surface 4 of the support grid 1, to a top edge 29 spaced from, i.e., lower than the top surface 2. The intermediate longitudinal reinforcement bar 26 also connects the lateral reinforcement bars 12 forming the sides of each relative grid section. The lateral and longitudinal reinforcement bars 10, 12, are similar in height to the sidewall 6, thus being in the range of about 2 to 5 inches and preferably about 3 inches. The thickness of the sidewall, reinforcement bars, intermediate reinforcement bars as well as the cleats 8 being about 0.25 to 0.5 of an inch and preferably about 0.38 of an inch. The intermediate longitudinal reinforcement bar 26 has a height h may be about one half the height of the longitudinal and lateral reinforcement bars 12, but is generally in the range of about 1 to 2.5 inches and preferably about 2 inches. As discussed, this assists with the traction of the vehicle by allowing a certain amount of the tread and the wheel to fall below the top surface 2 of the support grid 1 as defined by the top edges 18, 20 of the longitudinal and lateral reinforcement bars 14, 16. This permits more of the vehicle wheel to grip both the lateral and intermediate longitudinal reinforcement bars 10, 26 to provide traction, as well as permit additional contact and traction with the ground surface which becomes interspersed between grid sections 24.

It is notable that the intermediate longitudinal support 26 could also be aligned in parallel with the lateral reinforcement bars 12, however in the preferred embodiment the intermediate longitudinal supports 26 are parallel aligned with the longitudinal reinforcement bars 10 so that the torque applied by vehicle wheels perpendicularly directly against the lateral reinforcement bars 12 is better supported. In other words, where the vehicle direction of travel is substantially along the longitudinal axis l, the torque applied by the wheels of the ATV to the support grid 1 will generally be born directly by the lateral reinforcement bars 12 where they are contacted directly by the wheel. Without support, such torque could cause the lateral reinforcement bars 12 to twist, deform or even break. With the perpendicular support of the intermediate longitudinal supports 26 in addition to the support provided by the longitudinal reinforcement bars 10, the lateral reinforcement bars 12 are bolstered to resist the direct torque applied by vehicle wheels.

Turning to FIG. 6, the vehicle support grid 1 is further defined by the grid sections 24 being adjacently formed in lateral rows and longitudinal columns 32. In an advantageous aspect of the present invention, certain of these rows and columns are offset lateral rows 34 or offset longitudinal columns 36 from one another. This arrangement of offset lateral rows 34 and offset longitudinal columns 36 forms a jigsaw-like circumferential profile of the outer perimeter sidewall 6. By offsetting a lateral row of grid sections 24 by one grid section, a profile in the sidewall 6 is created having at least a recess 40 on one side of the support grid 1 and a protruding grid square 42 defining the sidewall on the opposing side of the support grid, i.e., on the other end of the respective lateral row. Similarly, one or more offset longitudinal columns 36 of grid sections 24 could be offset from the other columns 32 so that a recess 41 is formed in one end of the support grid 1 and a protruding grid square 43 extends at the opposite end of the support grid 1 from the recess.

It is also to be appreciated that the offset rows and columns 34, 36 do not have to be offset as described above or offset by a complete grid square 24. It could be that certain rows and columns may define a recess 40, 41 by providing one less grid section or a smaller grid section on the peripheral edge of the support grid 1 defining the sidewall 6. Similarly, an additional grid section or partial grid section may compliment the end of any row or column of grid sections 24 to provide a protruding extension 42, 43 to the sidewall 6 of the vehicle support grid 1.

It is to be recognized that each vehicle support grid 1 has a similar jigsaw-like profile of the sidewall 6 and thus each opposing side and opposing end of each vehicle support grid 1 being respectively complimentary, so as to flexibly engage and interleave with an adjacently positioned support grid 1. In this manner, the individual vehicle support grids 1 may be laid side by side and end-to-end and interleaved to the extent that while each vehicle support grid 1 may move independently in a vertical direction relative to one another and the ground. The support grids 1 are interleaved with the recess' 40, 41 defined on one support grid 1 engaging the corresponding protruding grid squares 42, 43 in the adjacent grid support sidewall 6, so as to prevent relative planar movement and rotation between one another and to prevent lateral and longitudinal displacement relative to one another and the ground.

When the support grid 1 is placed on the ground, whether on a trail, an open field or any other natural surface, the cleats 8 will sink into the ground until the bottom surface 4 of the support grid 1 presses against the ground surface. Although the support grid 1 may continue to sink down with use and time, the top surface 2 of the platform defines the new support surface for any off-road vehicle over the terrain. Although the soft, saturated or loose ground surface upon which the support grid 1 is placed may flow or be forced up into the grid sections 24, especially over time and use, this support grid 1 and the top surface 2 thereof, allows for a vehicle to travel along the trail, field, etc., without significantly impacting or destroying the ground underneath the support grid 1. As several of these platforms are laid adjacent and interleaved with one another, it is possible to cover the entire length of a desired environmentally sensitive area with these platforms without significantly disturbing the ground underneath and preventing further disruption, erosion or rutting.

Lastly, in this embodiment the preferable spacing between lateral reinforcement bars 12 is about 5 to 6 inches and also about 5 to 6 inches between longitudinal reinforcement bars 10. In this regard, the intermediate reinforcement bars are thus parallel spaced from the longitudinal reinforcement at about 2.5 to 3 inches. Such spacing can be important to the usefulness and function of the present invention in regards to ATV vehicles. If the grid sections 24 are too small, very little of the tire will be able to grip the reinforcement bars and the potential to slide off the support grid 1 and into the unprotected terrain is increased. If the grid sections 24 are to large, more radial surface are of the wheels will fall below the surface 2 of the support grid 1 and the ATV wheels will labor and thus require more torque to overcome the impediments presented by the reinforcement bars.

The jig-saw pattern of the present invention as discussed above allows for two similarly positioned adjacent support grids 1 to fit geometrically together without a secured fastening type device directly between each individual support grid 1 as shown in the previously known traction mats. Therefore, when one support grid 1 is already defining a pathway and a second support grid 1 is placed in the same direction, adjacent to the first support grid 1, the interleaved recesses and protruding grid sections will allow for each support grid 1 to have the ability to withstand the weight of a vehicle independently without transferring the vertically induced forces to adjacent support grids 1. However, because the jig-saw fit limits the degree of planar rotation between adjacent support grids 1, the platforms will not twist relative to one another and the pathway created by these platforms remains intact.

In FIGS. 7-10, a further embodiment of the vehicle support grid 1 is designed in regards to the needs of the off-road vehicle while traveling on sloped terrain. In this second embodiment in which like elements are identified by the same reference letters and numerals as in the first embodiment, a complete description of the common elements is not provided for sake of brevity. The difference in structure between this second embodiment and that previously disclosed is the alternation in the arrangement and height of certain of the longitudinal reinforcement bars 10 in order to provide better grip or traction for the vehicle wheels when traveling uphill or downhill.

This novel sloping terrain structural arrangement can be explained by understanding the increase in required torque for a vehicle traveling up or down an incline. When traveling on flat terrain, low to medium torque is sufficient to accelerate the vehicle under normal operating conditions. As the vehicle begins to ascend a slope, the necessary torque is greatly increased to compensate for the gravitational forces acting against the vehicle. Therefore, there is a much greater demand for power from the tires and hence an increase in torque to the wheels can lead to slippage between the wheels and the ground.

Figure 7:
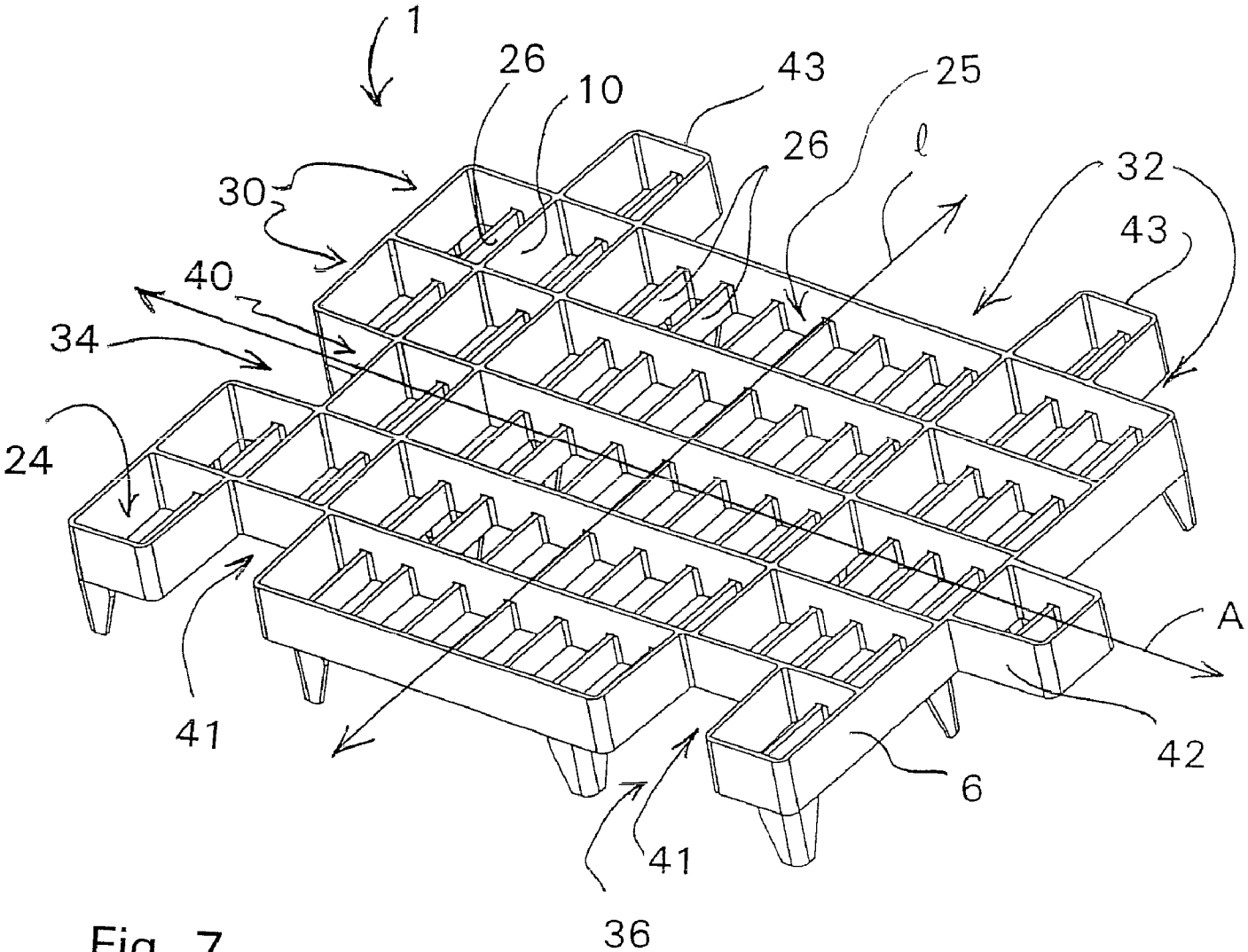
FIG. 7 is a perspective view of the top surface of a second embodiment of the present invention designed for use in sloping, hilly terrain.
Figure 8:
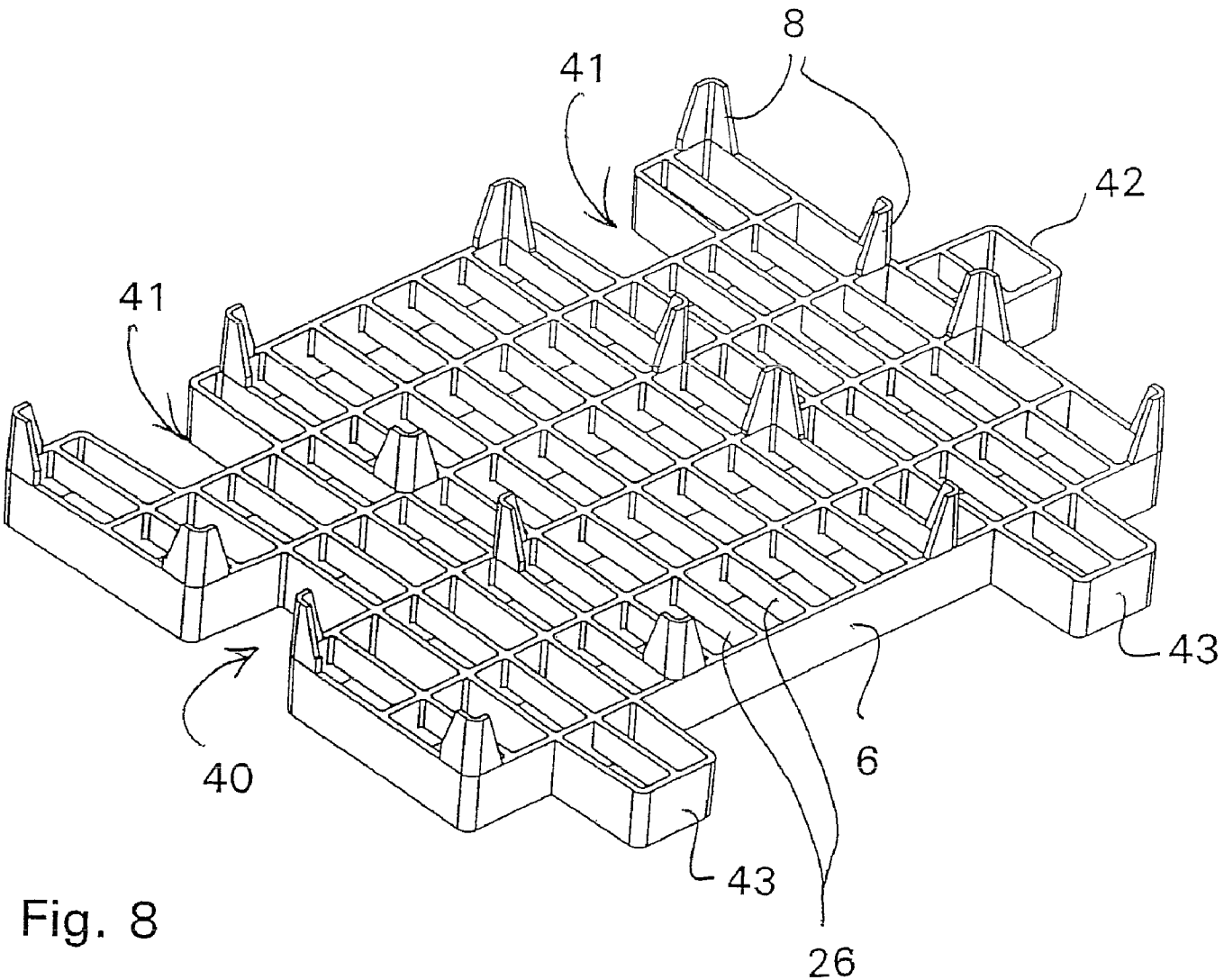
FIG. 8 is a perspective view of a bottom surface of the second embodiment of the present invention designed for use in sloping hilly terrain.

Observing a central portion of the vehicle support grid 1 as shown in FIG. 7, the longitudinal reinforcement bars 10, which define respective sides of the grid sections 24, are lowered to be the same or similar height as the intermediate longitudinal reinforcement bars 26. In this manner are created a plurality of adjacent intermediate longitudinal reinforcement bars 26 within elongate, rectangular shaped grid sections 25. These rectangular shaped grid sections 25 are aligned with their longer sides defined by the lateral reinforcement bars 12 parallel with the lateral axis A to facilitate better traction of the vehicle wheels as discussed in further detail below.

In this second embodiment, these plurality of adjacent intermediate reinforcement bars 26 may have a height of between about 1 to 2.5, and more preferably about 2 inches. The remaining longitudinal and lateral reinforcement bars 10, 12 may be generally the same height as described with respect to the first embodiment.

Similar to the first embodiment, the vehicle support grid 1 of the second embodiment is defined by the grid sections 24 and, also in this case, elongate grid sections 25, being adjacently formed in lateral rows and longitudinal columns 32. In an advantageous aspect of the present invention, certain of these rows and columns are offset lateral rows 34 or offset longitudinal columns 36 from one another. This arrangement of offset lateral rows 34 and longitudinal columns 32 forms a jigsaw-like circumferential profile of the outer perimeter sidewall 6. By offsetting a lateral row of grid sections 24 by one grid section, a profile in the sidewall is created having a recess 40 on one side of the support grid, and a protruding grid square 42 defining the sidewall on the opposing side of the support grid, i.e., on the other end of the respective lateral row. Similarly, one or more longitudinal columns 32 of grid squares could be offset from the other columns so that a recess 41 is formed in one end of the support grid and a protruding grid square 43 extends at the opposite end of the support grid from the recess 41.

It is also to be appreciated that the rows and columns do not have to be offset as described above or offset by a complete grid section. It could be that certain rows and columns may define a recess 40, 41 by providing one less grid section or a smaller grid section on the peripheral edge of the support grid 1 defining the sidewall. Similarly, an additional grid section or partial grid section may compliment the end of any row or column of grid sections 24 to provide a protruding extension 42, 43 to the sidewall 6 of the vehicle support grid 1.

Figure 10:
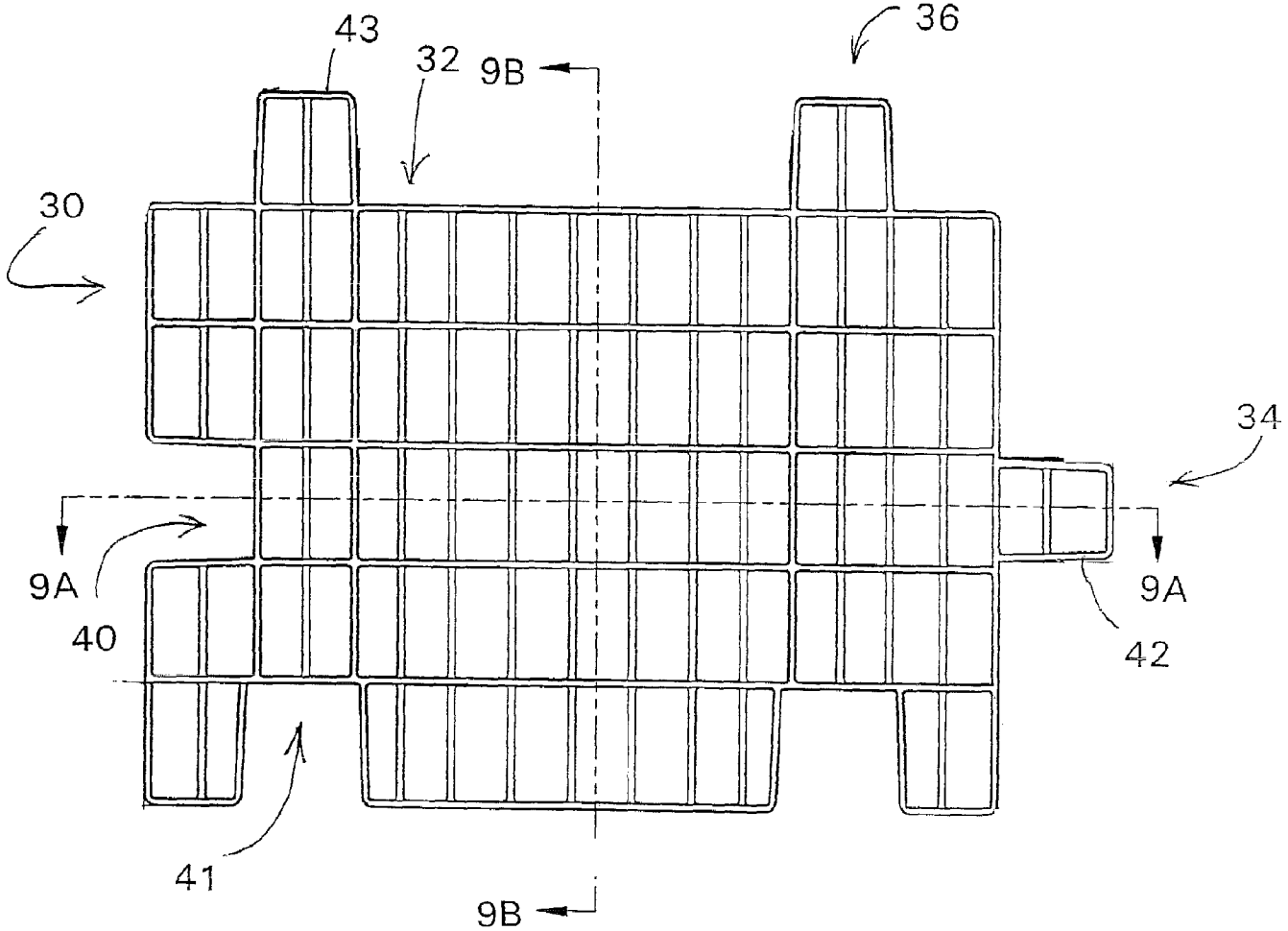
FIG. 10 is a top planar view of the top surface of the grid support of the second embodiment.

It is to be recognized, observing FIG. 10, that each vehicle support grid 1 has a similar jigsaw-like profile of the sidewall 6 and thus each opposing side of each vehicle support grid 1 being respectively complimentary so as to flexibly engage and interleave with one another. In this manner, the individual vehicle support grids 1 may be laid side by side and end to end, and interleaved to the extent that while each vehicle support grid 1 may move independently in a vertical direction relative to one another and the ground, the support grids 1 are interleaved with the recess 40 defined on one support grid 1 engaging the corresponding protruding grid square 42 in the adjacent grid support sidewall 6, so as to prevent relative planar movement and rotation between one another, and to prevent lateral and longitudinal displacement relative to one another and the ground. In general the vehicle support grids 1 of both the first and second embodiment have complimentary recesses and protruding grid sections 42, 43 so that flat terrain sections of the support grids 1 will interleave also with the sloping terrain support grids 1 of the second embodiment.

Also, as seen in FIG. 7 the grid sections 24 making up the left and right sides, i.e., the longitudinally aligned grid sections 24 making up the left and right sides on either side of the elongate grid sections 25 may be of different sizes. For example, observing FIG. 7, the grid sections on the right side of the support grid 1 may have a plurality of intermediate supports 26, where the grid sections on the left side are most similar to those of the first embodiment with only one intermediate support 26. This may facilitate better traction of a vehicle towards a center of adjacently side by side positioned support grids 1.

Turning to FIG. 9A, by lowering the height of certain of the adjacent longitudinal reinforcement bars 26 in the sloping terrain support grid 1 of the second embodiment to create the elongate grid sections 25, this embodiment allows for more surface area on the outer circumference of the tire to "sink in" to the platform, i.e., a larger radial portion of the wheel falls below the top surface 2 of the vehicle support grid 1, into the elongate grid section 25. The depth to which the radial portion of the wheel will fall is defined by the height h of the lower intermediate reinforcement bars 26. Thus, the wheel is provided with more circumferential surface area to grip, minimizing slip and maximizing traction between the wheel and the support grid 1. Greater traction allows the tire to more easily climb the sloped incline while also minimizing the risk of the vehicle slipping and sliding on an incline and creating damage to the trail.

Figures 11, 12:
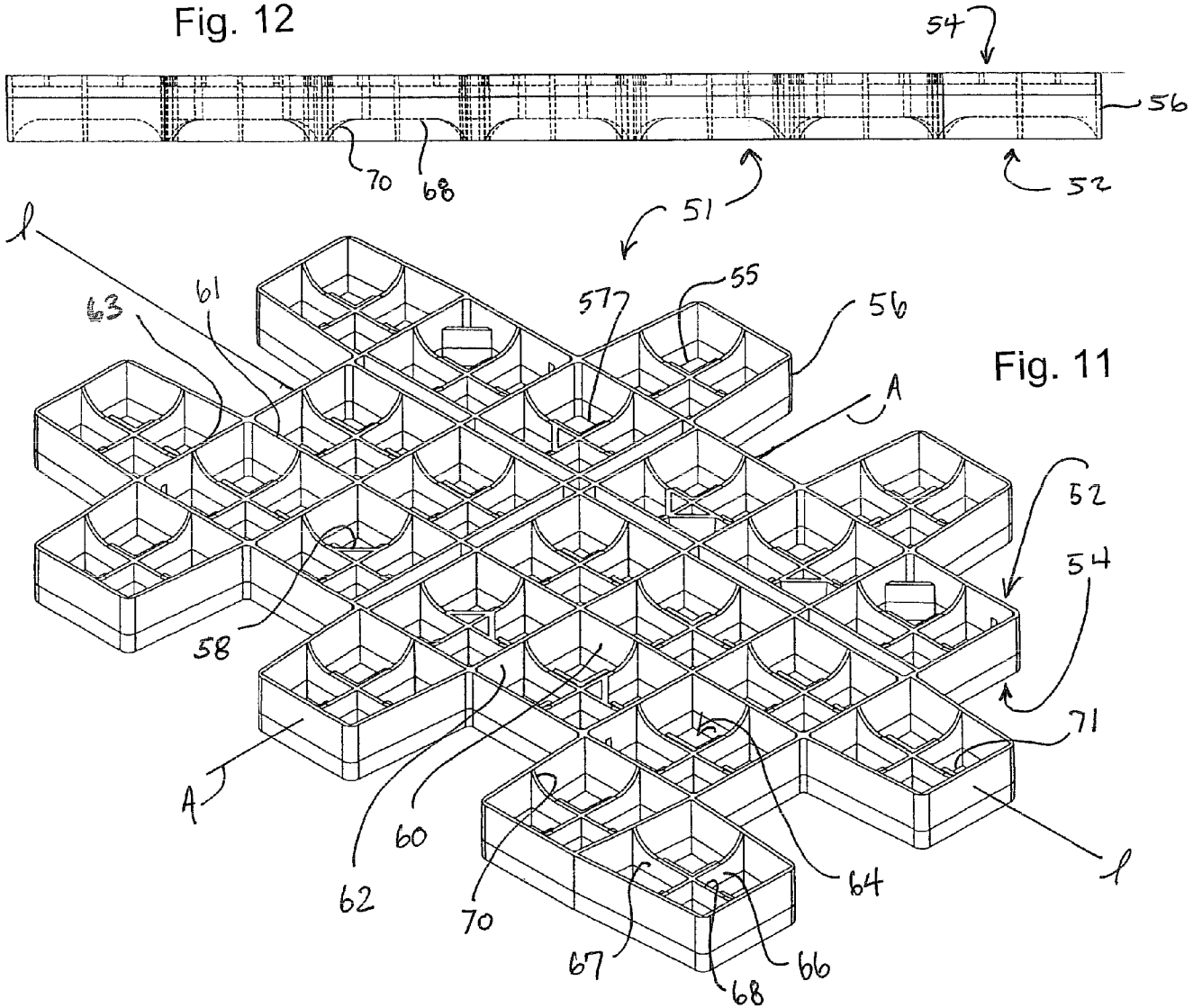
FIG. 11 is perspective view of a third embodiment of the present invention.
FIG. 12 is a side elevation view of the third embodiment.

In a further embodiment of the present invention, a support grid 51 is shown in FIG. 11 having a framework which, like the previously described embodiment is a substantially rigid, single-piece, molded grid structure. Also similar, the support grid 51 is defined by a top surface 52 and a bottom surface 54 and delineated by an outer perimeter sidewall 56. Different from the previous embodiment, support grid 51 has no integral cleats depending from the bottom surface 54. Instead, a series of peg bars 58 are provided to receive a separate peg (not shown) for assisting in anchoring the support grid 51 if necessary. A further description of the peg bars 58 is provided below. Without the cleats, the present embodiment can be turned, or flipped over so that the bottom surface 54, described in further detail below, constitutes a substantially planar support surface with smaller grid sections for pedestrians, i.e. human foot traffic, as opposed to the top surface 52 which is generally designed as a surface for vehicles with tires.

Each vehicle support grid 51 has a lateral width w and a longitudinal length L, the width w being in the range of about 30 to 60 inches, preferably about 42 inches, and the length being in the range of about 25 to 40 inches, preferably about 30 inches. The sidewall height is between about 2-5 inches and preferably about 3 inches. It is to be appreciated that the lateral width w, length L and sidewall height may be variable to some extent, and should not be unduly limited by the above noted ranges, however, it is important that within such ranges as defined above, the support grids 51 are easily stacked, carried and placed at an appropriate trail location by hand or from an ATV vehicle.

The support grid 51 has a grid pattern encompassed by the outer perimeter sidewall 56 composed of intersecting longitudinal reinforcement bars 60 and lateral reinforcement bars 62. For purposes of the following description, a longitudinal axis l is defined through the center of the support grid 51 aligned parallel with the longitudinal reinforcement bars 60. A lateral axis A is correspondingly defined through the middle of the support grid 51, but parallel aligned with the lateral reinforcement bars 62.

The longitudinal and lateral reinforcement bars 60, 62 intersect perpendicular with one another and are each provided with respective top edges 61, 63 which are co-planer with one another and further define the top surface 52, as well as bottom edges 55, 57 also co-planar with one another and together define the bottom surface 54 of the support grid 1 as seen in FIGS. 11 and 12.

The embodiment shown here is for use as either a support grid 51 for vehicles where the top surface 52 is exposed and the bottom surface 54 in contact with the ground, or upon the support grid 51 being flipped over so that the bottom surface 54 is exposed and the top surface 52 is in contact with the ground, the device may be used for a walking path for pedestrians where the bottom surface 54 provides a more stable walking surface due to the planar alignment of the webs 66, 67 and reinforcing bars 60, 62 discussed in further detail below.

As seen in FIG. 11, in this second embodiment the perpendicularly aligned longitudinal and lateral reinforcement bars 60, 62 define a plurality of grid sections 64. Each grid section 64 in the present embodiment is shown substantially as square or rectangular in nature, although other shapes may be possible as well, where each side of the grid section 64 is formed by portions of the intersecting longitudinal and lateral reinforcement bars 60, 62. Each grid section 64 is divided by a lateral and longitudinal perpendicularly intersecting reinforcement webs 66, 67, which are aligned substantially parallel, but spaced from the respective lateral and longitudinal reinforcement bar 60, 62 forming the sides of each grid section 64. Correspondingly, the lateral and longitudinal reinforcement webs 66, 67 are integrally connected at a right angle with one another in the center of each grid section 64.

Each of the respective reinforcement webs 66 and 67 have a bottom edge 71 generally planar aligned with the respective bottom edges 55, 57 of the lateral and longitudinal reinforcing bars 60, 62. The webs 66, 67 also have a flat web top edge 68 defining an intermediate plane between the top surface 52 and the bottom surface 54 and parallel aligned with the planes defined by the respective top and bottom surfaces 52, 54. This flat web top edge 68 on both the longitudinal reinforcing web 66 and lateral reinforcing web 67 extends from the intersection of the reinforcement webs 66, 67 outwards toward the respective lateral and longitudinal support bars 60 and 62. Each flat web top edge 68 is connected to the respective lateral or longitudinal support bar 60, 62 by a web slope top edge 70 which extends upwards from the flat web top edge 68 defining the intermediate plane of the support grid 51, to the top edges 61, 63 of the respective longitudinal and lateral bars. This web slope top edge 70 increases the stability of the reinforcing bars 60, 62 by providing support along the entire height of the lateral and longitudinal reinforcing bars. The web slope top edge 70 may be a constant slope or also curved as shown in FIGS. 11 and 12. But in any event, the slope or curve extends between the intermediate plane defined by the flat top edge 68 and the plane defined by the top edges 61, 63 of the reinforcing bars 60 and 62.

Figure 13:
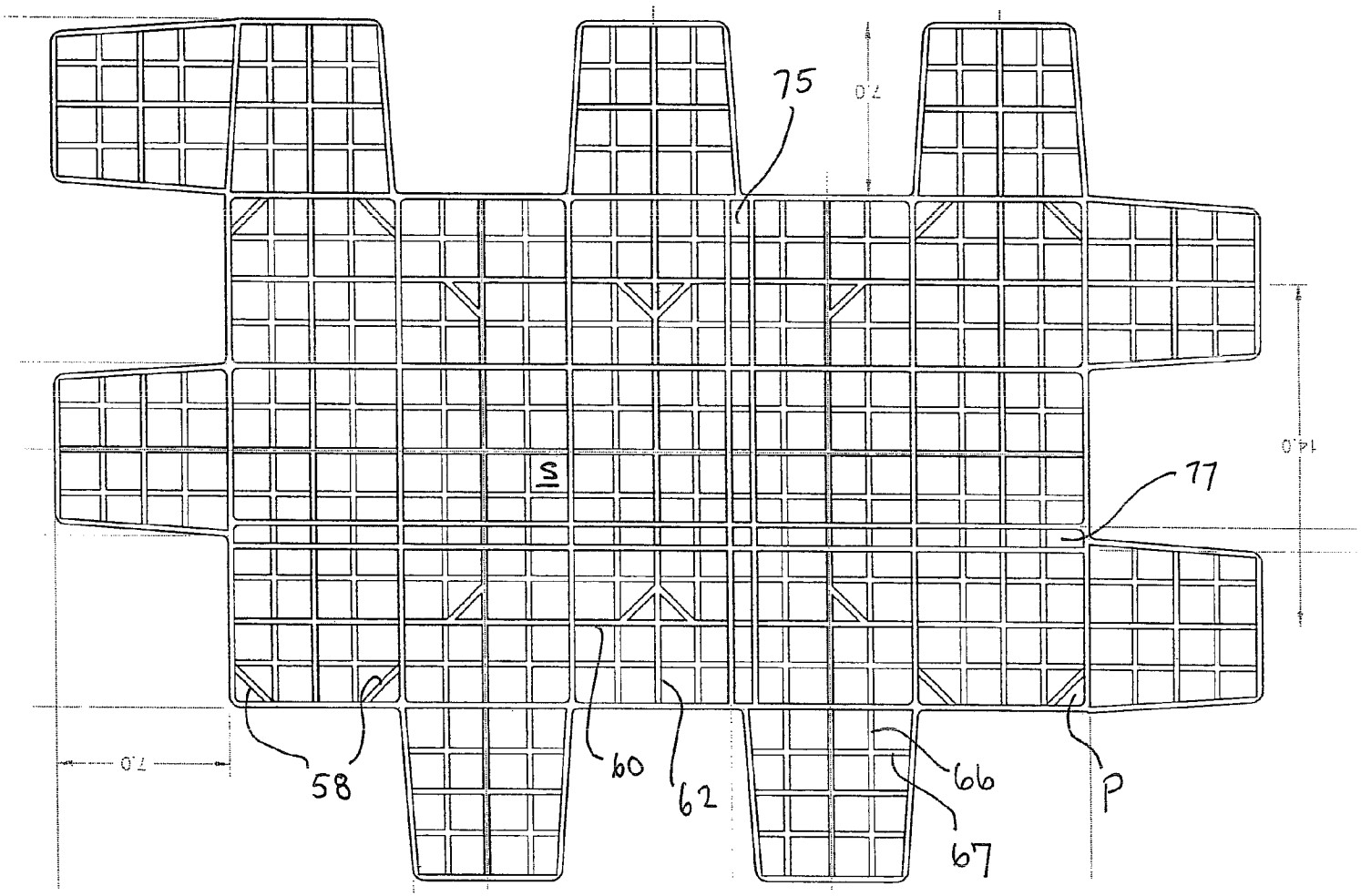
FIG. 13 is a top plane view of the grid support of the third embodiment.
Figure 14:
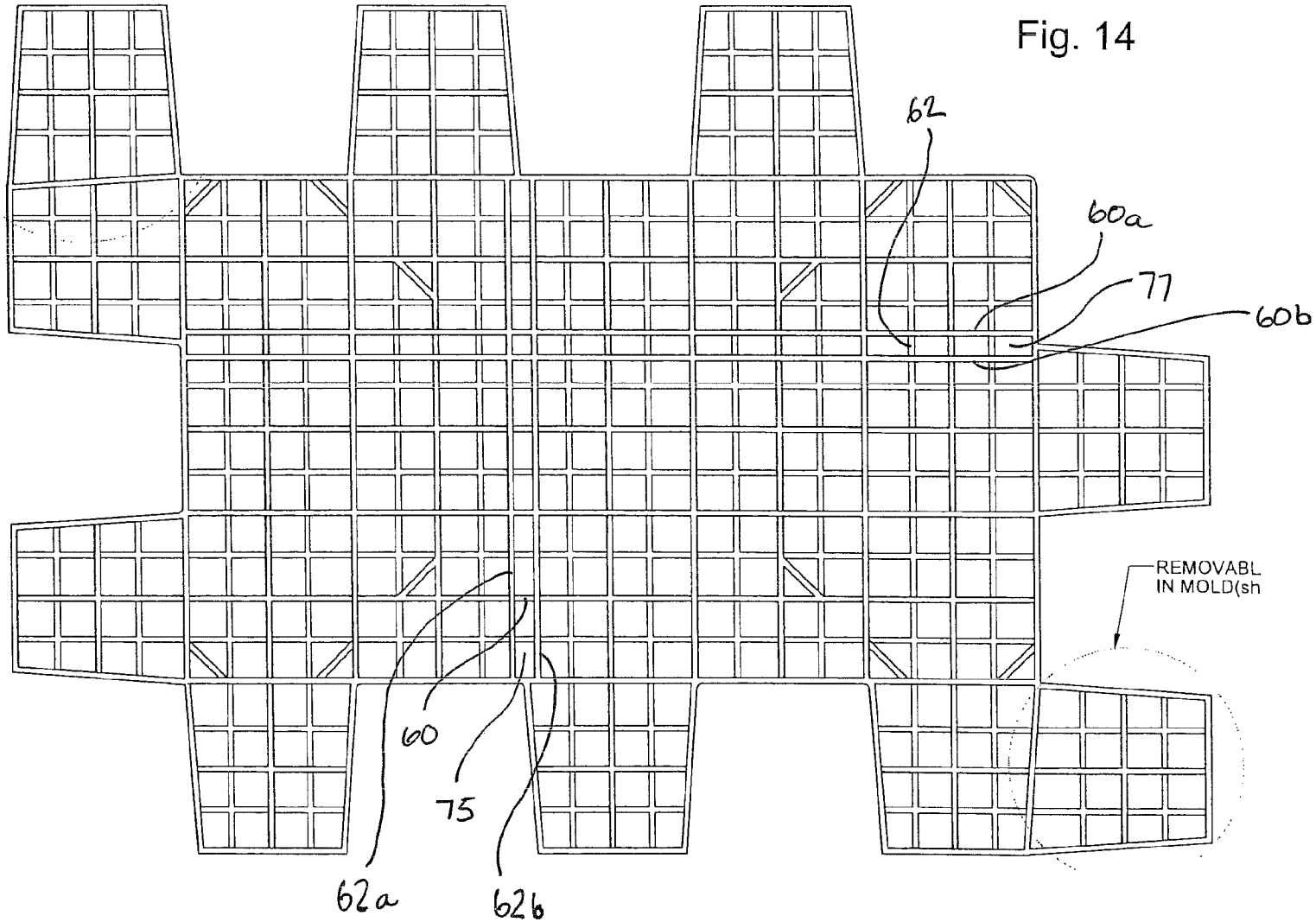
FIG. 14 is a top plan view of an alternative arrangement of the peg bars for the grid support of the third embodiment.

Observing FIGS. 13 and 14, while the above described lateral and longitudinal side walls 60, 62 and lateral and longitudinal reinforcement webs 66 and 67 form a plurality of substantially rectangular or square minor grid sections S, the peg bars 58 extend at approximately forty-five degree, 45° angle between adjacent lateral and longitudinal reinforcing bars 62, 60 and/or, lateral and longitudinal reinforcement webs 66 and 67 and alternatively, between perpendicularly adjacent webs and bars.

The peg bars 58 extend at approximately a 45° angle relative to each of the respective bars and/or webs to which it is attached and constitutes the formation of a generally right angular passage P within the minor grid sections S. This right angular passage P is important in that a separate cleat or peg (not shown) for securing the grid support 51 is provided having matching right angular surfaces to facilitate secure entry downward through the right angle space and into the ground to secure the grid 51 to the surface upon which it is supported. By way of example, a tent peg which as generally known has a longitudinal right angular bend may be inserted into the right angular passage P and then pushed downward into the soil in order to secure the support grid 51. It is important to note the right angular formation of the cleats or pegs which facilitates maintaining the support grid in position once positioned on the ground. The right angular nature of the cleats or pegs presents perpendicularly adjacent walls similar to those sidewalls 9 and 11 seen in the integral cleats 8 of the previous embodiment to provide both lateral and longitudinal support horizontally against the ground into which the pegs or cleats are placed. Such lateral and longitudinal support keeps the support grid 51 from moving horizontally or twisting once positioned in the ground.

Additionally, because the top edge of the peg bar 58 is below the top edges 61, 63 of the reinforcing bars 60, 62 and the peg bar 58 is substantially aligned with the intermediate plane defined by the flat web top edges 68, any securing peg or cleat used therewith does not interfere with the vehicle passing over the grid.

Another feature of the second embodiment of the support grid 51 as seen in FIG. 14, is a lateral and longitudinal cut channel 75, 77 formed therein. The longitudinal cut channel 77 is defined by slightly spaced apart longitudinal reinforcing bars 60*a*, 60*b* so as to form the narrow channel therebetween along substantially the entire length of the support grid 51. The longitudinal cut channel 77 is traversed by respective lateral reinforcing bars 62, the channel 77 provides for a space whereby a saw blade or other cutting instrument can be run through the channel 77 severing the lateral reinforcing bars 62 therein, or other such connecting portions and so change either the width w of the support grid 51. Similarly, the lateral cut channel 75 is defined by slightly spaced apart lateral reinforcing bars 62*a*, 62*b* so as to form the narrow channel there between along substantially the entire width of the support grid 51. The lateral cut channel 75 is traversed by respective longitudinal reinforcing bars 60, the channel 75 provides for a space whereby a saw blade or other cutting instrument can be run through the channel 75 severing the longitudinal reinforcing bars 60 therein, or other such connecting portions and so change the length of the support grid 51.

Figure 15:
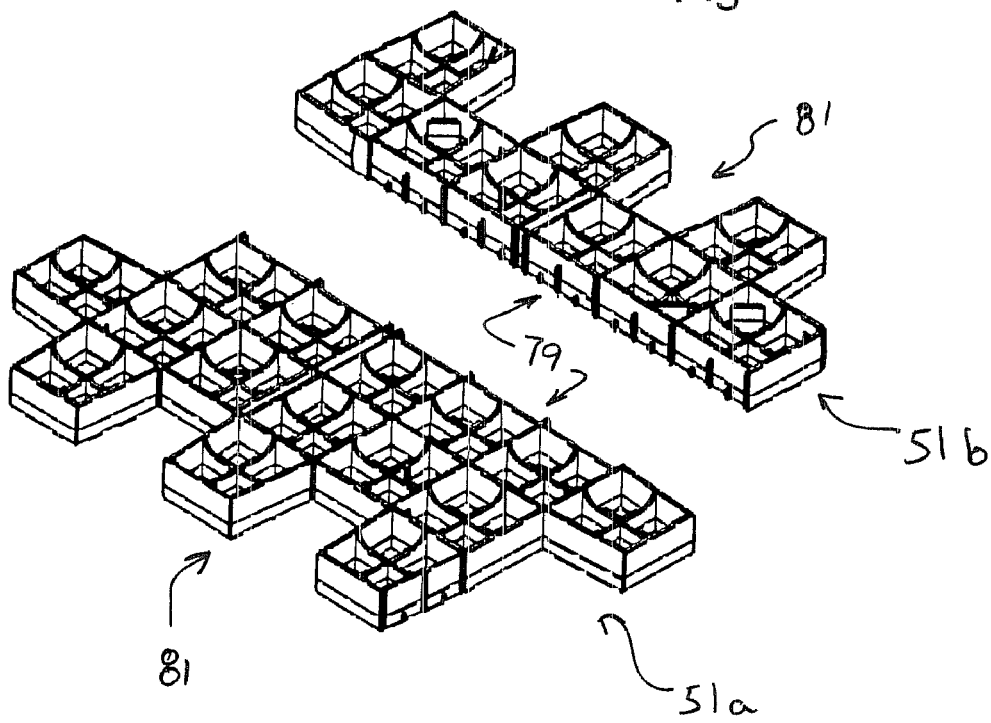
FIG. 15 is a perspective view of the support grid split into separate sections along a longitudinal cut channel.
Figure 16:
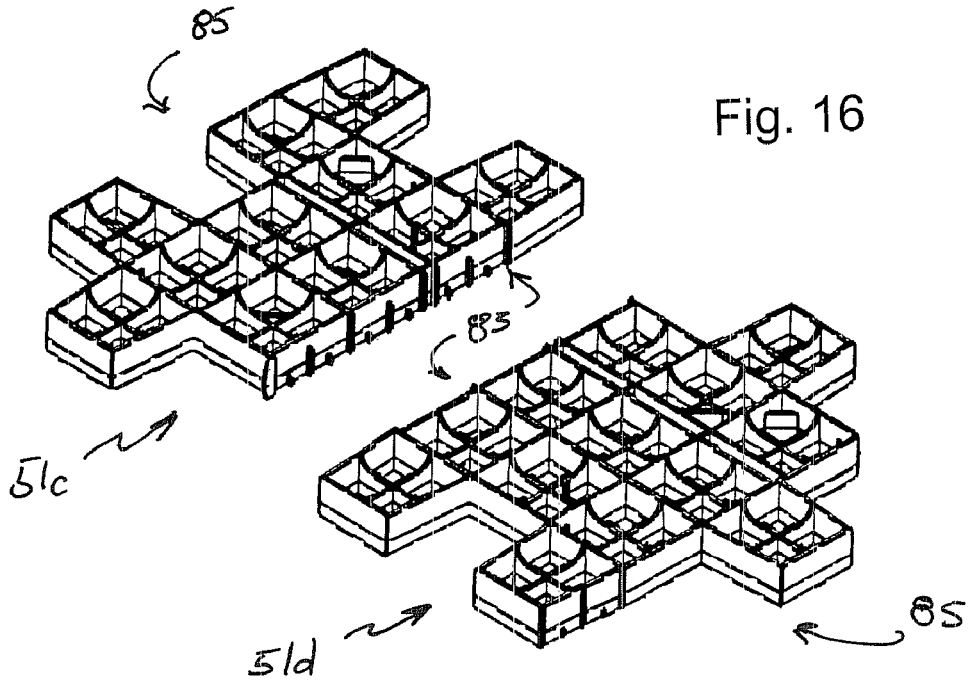
FIG. 16 is a perspective view of the support grid split into separate sections along a lateral cut channel.

Observing FIGS. 15 and 16, in FIG. 15 we see the longitudinal cut channel 77 has been severed to separate the support grid 51 into separate longitudinal pieces 51*a*, 51*b*. Each piece 51*a*, 51*b* having a substantially flat planar sidewall 79 and a crenellated side wall 81. In FIG. 16, the lateral cut channel 75 has been cut to separate the support grid 51 into corresponding lateral sections 51*c*, 51*d*. The cutting or severing of the respective longitudinal support bars 60 inside the channel 75 forms the separation along the lateral cut channel and each piece 51*c*, 51*d* having a substantially flat planar sidewall 83 and a crenellated side wall 85.

Figure 17:
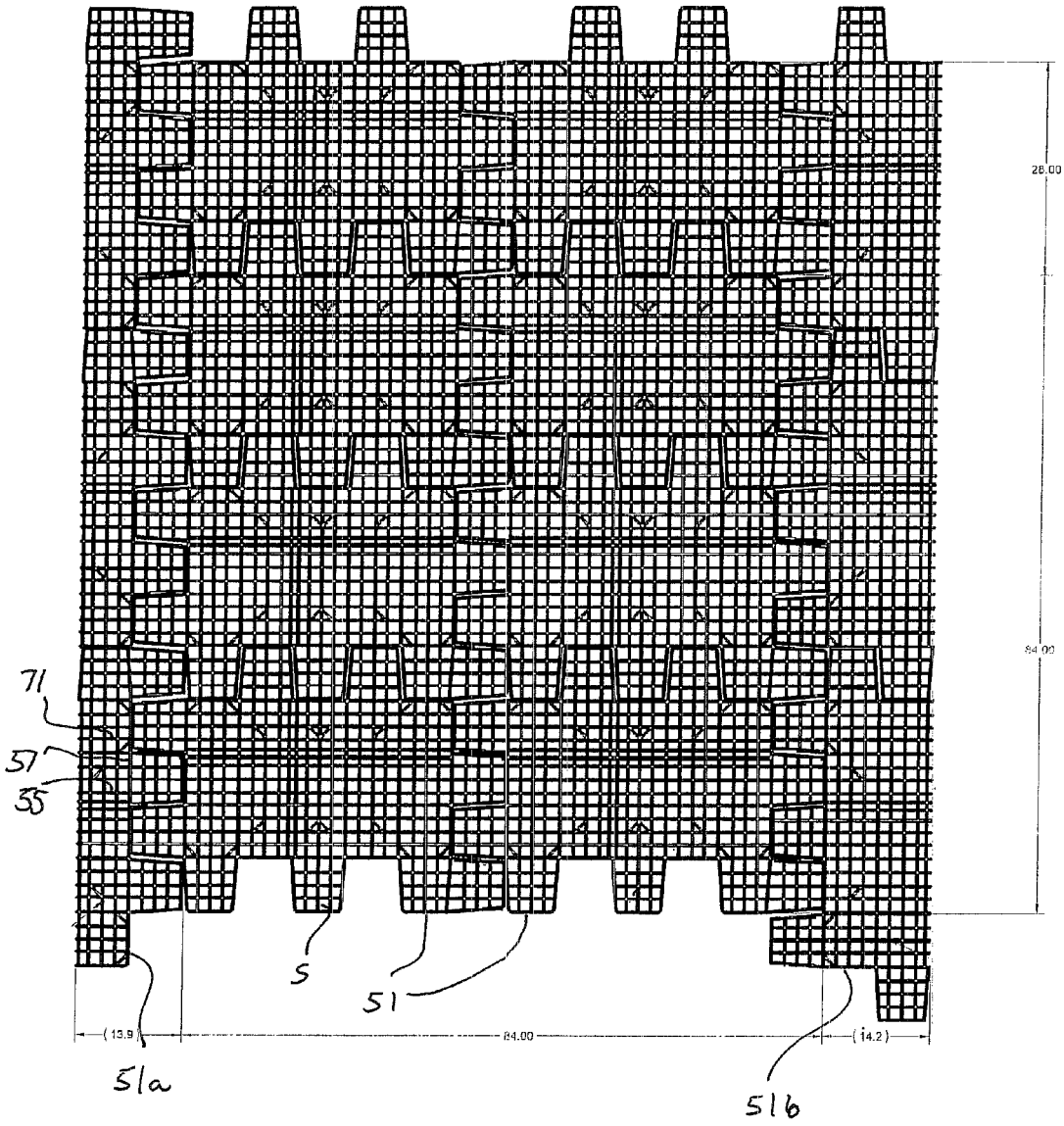
FIG. 17 is a top plan view of a series of grid supports and grid support pieces arranged to form a pedestrian walkway.

The ability to separate or cut the support grid 51 into separate sections 51*a-d* is important as seen in FIG. 17 where we observe a number of the support grids 51 and 51*a,b* arranged to form a pedestrian walkway. In this configuration where the bottom surface 54 of the grids 51 is now exposed (and the top surface 52 flipped over and in contact with a supporting ground surface) each grid 51 and 51*a,b* is interlocked with other grid sections to form the pedestrian walking support where the smaller minor grid sections S are defined by the planar aligned bottom edges 55 and 57 of the reinforcing bars 60, 62 and the bottom edges 71 of the longitudinal and lateral reinforcing webs 66 and 67. In this example, there is shown two adjacent whole, i.e. unbroken, support grids 51 interlocked together. The free sides of the interlocked whole grid supports 51 are engaged with the respective longitudinal cut sections 51*a*, 51*b* as shown in FIG. 15. These cut sections 51*a*, 51*b* are interlocked such that the crenellation side walls 81 engages with the crenellations formed on the whole grid supports 51 and the planar sidewall 79 of cut sections 51*a*, 51*b* are aligned to define the linear outer edge of the walkway. This is critical where the grid supports are utilized for pedestrians on both sides of the walking trail which is particularly important so that foot traffic does not slip or fall between crenelation sections and the path is consistent and better linearly defined.

Since certain changes may be made in the above described improvement, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A support platform for use in protecting off- road trails and ecologically sensitive terrain comprising:

a molded platform having a contiguous sidewall defining an outer edge of the platform and connecting a plurality of longitudinal and lateral intersecting support walls defining a planar top and bottom surface for supporting one of a vehicle or pedestrian thereon;

at least one of a recess or projection formed by the sidewall in the outer edge of the molded platform, the recess or projection being sized to receive, or to be received by a corresponding projection or recess in an adjacent support platform;

an intersection of the plurality of longitudinal and lateral intersecting support walls defines a plurality of separate grid sections having an intermediate web connected between at least one of the parallel adjacent longitudinal support walls and the parallel adjacent lateral support walls forming each of the separate grid sections; and wherein the intermediate web comprises a middle portion defined by a substantially planar top edge and connecting end portions defined by a sloping top edge extending from the planar top edge to at least one of the parallel adjacent longitudinal support walls and the parallel adjacent lateral support walls forming each of the separate grid sections.

2. The support platform as set forth in claim 1 wherein the intermediate web has a bottom edge planarly aligned with the planar bottom surface of the support platform and a top edge of the intermediate web having a height substantially lower than the a top edge of the longitudinal and lateral intersecting support walls defining the top surface of the support platform.

3. The support platform as set forth in claim 1 wherein the plurality of separate grid squares forms a contiguous array of perpendicularly aligned lateral rows and longitudinal columns and the intermediate web is parallel aligned with an intended direction of travel of vehicles over the support platform.

4. The support platform as set forth in claim 3 wherein at least one of said perpendicularly aligned lateral rows and longitudinal columns is offset from other of the respective perpendicularly aligned lateral rows and longitudinal columns to define a recess in a portion of the sidewall and a projection in an opposing portion of the sidewall.

5. A support grid for providing traction for a vehicle or human over terrain, the support grid comprising a plurality of integrally intersecting support walls defining a plurality of openings through the support wherein the support walls define a planar vehicular surface for directly supporting the vehicle and an opposing planar walking surface for supporting walking pedestrians, wherein the openings are substantially divided by a pair of intersecting intermediate support walls having a height substantially less than that of the intersecting support walls.

wherein a top edge of each of the pair of intersecting intermediate support walls is defined by a flat planar middle portion and sloping connecting ends extending from the flat planar middle portion to the intersecting support walls.

6. The support grid as set forth in claim 5 wherein a top edge of the pair of intersecting intermediate support walls is substantially spaced from the planar vehicular surface, and a bottom edge of the pair of intersecting intermediate support walls is co-planarly aligned with the planar walking surface.

7. The support grid as set forth in claim 5 further comprising a channel formed between adjacent first and second rows of openings wherein the channel is defined by a parallel spacing between a first support wall of the first row and a second support wall of the second row.

8. The support grid as set forth in claim 5 further comprising an angled bar extending between at least one of perpendicularly intersecting support walls, perpendicularly intersecting intermediate support walls and perpendicularly intersecting support wall and intermediate support wall.

* * * * *